US005498322A

United States Patent [19]

Byrne

[11] Patent Number: 5,498,322

[45] Date of Patent: Mar. 12, 1996

[54] ALUMINUM ALLOY CATHODE PLATE FOR ELECTROWINNING OF ZINC

[75] Inventor: Stephen C. Byrne, Monroeville, Pa.

[73] Assignee: Aluminum Company of America, Pittsburgh, Pa.

[21] Appl. No.: 283,597

[22] Filed: Aug. 1, 1994

[51] Int. Cl.[6] ..... C25C 1/16

[52] U.S. Cl. ..... 205/603

[58] Field of Search ..... 204/115, 114, 204/119

[56] References Cited

U.S. PATENT DOCUMENTS

| | | | |
|---|---|---|---|
| 1,255,433 | 2/1918 | Laist et al. . | |
| 2,443,112 | 6/1948 | Morin | 204/267 |
| 3,579,431 | 5/1971 | Jasberg | 204/275 |

FOREIGN PATENT DOCUMENTS

| | | |
|---|---|---|
| 923845 | 4/1973 | Canada . |
| 1046799 | 1/1979 | Canada . |

*Primary Examiner*—Kathryn Gorgos
*Attorney, Agent, or Firm*—Carl R. Lippert

[57] ABSTRACT

Cathode plate aluminum sheet product for use in electrowinning of zinc in sulfuric acid containing electrolyte bath comprises an alloy (a) consisting essentially of about 0.2 to 0.5% magnesium, 0.15% maximum silicon, 0.1% maximum iron, 0.05% maximum copper, and 0.05% maximum zinc, the balance substantially aluminum and incidental elements and impurities, the aluminum amounting to at least 99% of aluminum alloy, or (b) consisting essentially of about 0.08 to 0.23% silicon, 0.1% maximum iron, 0.05% maximum copper, 0.05% maximum magnesium, 0.05% maximum zinc, the balance substantially aluminum and incidental elements and impurities, the aluminum being at least 99.4% of said alloy. The sheet products are work hardened by cold rolling and have a minimum yield strength of at least 14 ksi, preferably at least 15 or 16 ksi, and an electrical conductivity of preferably 58% I.A.C.S. or more together with good corrosion resistance. The combination of properties enables longer cathode service life in the harsh sulfuric acid containing electrolytic cell.

8 Claims, No Drawings

ALUMINUM ALLOY CATHODE PLATE FOR ELECTROWINNING OF ZINC

This invention relates to an improvement in the electrowinning of zinc and, more particularly, to aluminum alloy sheet products for use as cathode plates in electrowinning of zinc by electrodeposition. Zinc is conventionally produced by electrolytic deposition from an acidic zinc sulfate solution in which zinc metal is deposited on an aluminum cathode sheet or plate. The zinc product is periodically removed or stripped from the aluminum cathode sheets by scraping, prying or chipping the zinc off the aluminum cathode sheets. The stripping or zinc removal operation is a harsh operation which requires a substantial degree of robustness in the aluminum cathode plates to enable repeated use thereof.

The robustness of the aluminum cathode plate material is further tested by the fact that the electrolysis is carried out in a zinc sulfate-sulfuric acid electrolyte which can contain around 45 to 60 grams per liter of zinc as zinc sulfate, typically around 55 or 60 grams per liter zinc as zinc sulfate, along with about 100 to 200 or possibly more grams per liter (g/l) of sulfuric acid, typically around 180 or 200 g/l, and further agents which may be included in the electrolyte. This electrolyte is quite corrosive, especially at the interface between the electrolyte and the air space above it. Normally, lead containing anodes are used in the cell and current densities of 200 or 300 to about 800 or 850 or more amps per square meter, and temperatures of around 30° or 35° C. (86° or 95° F.) to about 40° C. (104° F.) or more are employed. A typical temperature in a commercial cell is about 38° C. (around 100° F.) to 40° C. or a little higher, and these temperature levels can intensify the corrosion effects. Electrical conductivity is also a concern in that a conductivity of at least 60% of the International Annealed Copper Standard (IACS) is desirable although zinc producers can settle for a little less, such as 58%. In general, higher conductivity, such as 60 or 61%, aids in current handling and is preferred. However, a slightly lower conductivity, such as 58%, is considered quite acceptable if combined with very good corrosion resistance since rapid corrosion removes conductance metal requiting that the remaining metal carry all the current. If the corrosion is slowed, more current carrying metal remains and a lower conductivity is quite acceptable.

The above-referred to removal of zinc from the cathode plates involves removing the cathode plates or lifting them from the cell and returning the cathode plates to the cell after the zinc is removed. The cathode plates can be cleaned such as by brushing or washing, or both, prior to being returned to the cells. In some cases, the removal of the zinc from the cathode plates involves the use of crowbars and other prying devices which can be extremely harsh on the cathode plate which, in turn, requires a degree of robustness to withstand the repeated stripping or removal of the zinc product and the harshness involved in that operation. That harshness plus the harshness of the environment, especially the corrosive electrolyte fumes, at the electrolyte-air interface, requires a robust product both from the standpoint of chemical attack and physical attack. Corrosion at the electrolyte-air interface thins the cathode plate, reducing current carrying capability and plate strength and robustness, and accordingly shortening useful cathode plate life. If a cathode plate could sustain a 10% increase in useful life, it would be a substantial improvement.

Typical cathode life in present relatively high productive commercial cells is around 14 to 18 months for a plate 0.25 inch thick. Attaining 20 or more months, for instance 22 or 24 months' life, would be quite useful. Generally speaking, greater strength, hardness and corrosion resistance can cooperate to enhance cathode plate life. Corrosion removes metal in the electrolyte bath surface region and this metal removal weakens the plate at that site. If the metal has a low yield strength, that compounds the problem because the metal remaining after the corrosion effect has difficulty coping with the forces encountered in removing the zinc. Hence, a higher strength and better corrosion resistance cooperate to increase cathode plate life. Hardness also contributes to robustness in sustaining the day-to-day prying and gouging effects encountered in stripping zinc product off the plate.

There are numerous disclosures in the prior art concerning the electrolysis of zinc, including Canadian Patents 923,845 and 1,046,799 and U.S. Pat. Nos. 3,579,431, 2,443,112, and 1,255,433, all of which are hereby incorporated fully by reference.

Prior cathode plates for electrolysis of zinc have either been pure aluminum or relatively high purity aluminum, or in some cases commercially pure aluminum such as 1050 (99.5% pure) which is sometimes specified by zinc producers, and in other cases specially alloyed aluminum, but there remains room for improvement. In general, very pure aluminum, for instance, 99.99% pure aluminum, has good corrosion resistance and electrical conductivity but is very weak and soft and has trouble standing up to harsh use. Lower purity grades of commercial aluminum, such as Aluminum Association (AA) alloy 1050 or 1070, have less corrosion resistance than pure aluminum and stronger alloys have quite low corrosion resistance in sulfuric acid despite their better strength (before corrosion takes its toll).

DETAILED DESCRIPTION

In accordance with the invention, it has been discovered that certain specific aluminum alloys function very well as cathode plates for use in electrolysis of zinc. One alloy, herein called Alloy 1, contains about 0.2 or 0.25 to about 0.45 or 0.5 or 0.55%, or possibly 0.6% magnesium, the balance mainly aluminum. Alloy 1 preferably contains no more than 0.15 or 0.2% silicon, preferably less than 0.15%, and more preferably less than 0.12% silicon; not over 0.1 or 0.15% iron, preferably less than 0.1%, or more preferably less than 0.08% iron; preferably no more than 0.05 or 0.07% copper, more preferably less than 0.05% copper, and still more preferably less than 0.03% copper; and preferably not more than 0.05 or 0.07% zinc, more preferably less than 0.05% zinc, still more preferably less than 0.03% zinc. Most preferably, Alloy 1 contains about 0.3 to 0.5% magnesium, the balance aluminum and up to 0.4 or 0.5% of everything else combined. Alloy 1 preferably contains at least about 99 or 99.1% aluminum. Unless indicated otherwise, alloy compositions herein are by weight percent.

Another alloy in accordance with the invention, herein called Alloy 2, contains about 0.08 or 0.1% to about 0.2 or 0.23 % silicon, preferably about 0.1 to 0.2% silicon. The limits for iron, copper and zinc are as described above for Alloy 1, and Alloy 2 contains not more than 0.05 or 0.07% magnesium, preferably less than 0.05% magnesium, more preferably less than 0.04% magnesium. Alloy 2 preferably contains at least about 99.3 or 99.5% aluminum.

The aforesaid alloys in accordance with the invention may be produced by various methods, typically ingot derived by continuously or semi-continuously casting into stock for rolling, followed by rolling. In one preferred embodiment, the alloy is cast as a relatively large commercial size ingot, for instance, about 16 or 20 inches thick, and then hot rolled to a suitable gauge, such as about 0.3 or 0.4 inch, which is then preferably followed by cold rolling to impart a work hardened temper to the cathode plate. Prior to hot rolling, the alloy should be homogenized or preheated at around 750° or 800° to about 950° or 1000° F., suitably around 850° F. Hot rolling can be commenced at around 800° or 850° F.

After hot rolling, if employed, or prior to cold rolling, the metal may be annealed although it is often preferable to avoid annealing treatments. It is also preferred to avoid intermediate anneals during cold rolling, although intermediate anneals may be employed as appropriate, it being remembered that a significant amount of cold reduction, for instance, a cold rolling reduction of at least 25% or 30%, preferably at least 35 or 40%, for instance 45% or 50% or more in cross-sectional area is desirable in practicing the invention for achieving higher levels of strength and robustness. The cold rolled metal is in work hardened temper, typically H16 temper. The metal could be cold rolled even further, for instance, to an H18 temper level and used as cathode plate in that condition or possibly be partially annealed or thermally treated to soften it a relatively small amount to produce a temper condition similar in properties to an H26 or H28 temper condition (which can be considered substantially work hardened condition) but not thermally treated so much as to lower strength more than desired. Also, the alloy could be continuously cast as a slab, for instance around 0.5 or 0.6 inch thick, and cold rolled from that thickness to substantially cathode plate thickness which is typically around ¼ inch thick or about 3/16 inch thick but can be from as thin as around 0.05 inch or more, and can range from around 0.1 or 0.125 inch to about 0.26 or 0.27 or 0.28 inch thick or more, for instance, 0.3 or possibly 0.35 inch thick or more. Many current commercial cathode plates are around 3/16 inch or ¼ inch thick, or 0.275 inch thick, as just indicated.

Improved cathode plate in accordance with the invention can have a guaranteeable minimum longitudinal yield strength of about 14 ksi minimum, preferably about 15 ksi minimum, more preferably about 16 or 17 ksi, especially for Invention Alloy 1 cathode plate which can have a guaranteeable minimum yield strength of 18 ksi, for instance in thinner gauges. These guaranteeable minimum strength levels are achieved in a substantially work hardened condition such as an H16 type work hardened temper strength level. These guaranteeable minimum strength levels are necessarily less than typical measured values but are higher than guaranteed minimum strength of 11 ksi for alloy 1060-H 16. In addition to the strength level, the improved cathode plate can have a guaranteeable minimum electrical conductivity of at least 57 or 58% I.A.C.S., or on a less preferred basis at least 56%. Invention Alloy 2 can have a guaranteeable minimum conductivity of at least 58 or 58 or even 60% I.A.C.S.

EXAMPLE

Alloys in accordance with the invention were cast in large commercial size ingots and hot and cold rolled to H16 temper sheet about 3/16 (0.186 inch actual) inch thick and suitable for use as cathode plate. Comparison cathode plate material was also made in high purity aluminum (99.99% pure A1) and in Alloy 1070 along with an alloy "Alloy A", similar to Alloy 1050 except for containing 0.05% titanium. The plates were each tested for corrosion in a water solution containing 200 grams per liter (g/l) sulfuric acid and 60 g/l zinc sulfate at 38° C. (about 100.4° F.). This solution is considered a useful test for corrosion resistance as it represents the higher levels of commercially used concentrations. The chemical compositions for the alloys are listed in Table 1 (no composition listed for 99.99% high purity A1).

Corrosion test results are shown in Table 2. Corrosion was measured in a 44-hour test and reported in terms of weight loss per day (grams/square meter lost weight per day) and in terms of corrosion penetration into each face (two sides per plate) reported as inches per year on each face. From these data (largely penetration per year), a projected life is listed in Fable 2 for different thicknesses of cathode plate based on remaining metal thickness (original thickness minus corrosion penetration being reduced to 0.080 inch thickness at the electrolyte-air interface.

The longitudinal strength properties and the hardness and electrical conductivity were also measured for each alloy plate and are listed in Table 3.

TABLE 1

| | Composition | | | | | | |
|---|---|---|---|---|---|---|---|
| | Si | Fe | Mg | Mn | Cu | Zn | Ti |
| Invention Alloy 1 | 0.07 | 0.061 | 0.33 | 0.001 | 0.001 | 0.004 | 0.012 |
| Invention Alloy 2 | 0.13 | 0.073 | 0.001 | 0.000 | 0.001 | 0.004 | 0.012 |
| Alloy 1070 | 0.04 | 0.10 | 0.000 | 0.000 | 0.000 | 0.000 | 0.01 |
| Alloy A | 0.051 | 0.30 | 0.000 | 0.001 | 0.001 | 0.004 | 0.050 |

TABLE 2

| | Corrosion | | | | |
|---|---|---|---|---|---|
| | Weight Loss | Penetration Inch/Year | Projected Life (months) Starting Plate Thickness | | |
| Alloy | g/sq meter/day | on each face | 0.188 | 0.250 | 0.275 |
| Invention 1 | 7.3 | 0.039 | 17 | 26 | 30 |
| Invention 2 | 8.3 | 0.044 | 15 | 23 | 26 |
| High Purity Al | 6.1 | 0.032 | 20 | 31 | 36 |
| Alloy 1070 | 9.4 | 0.050 | 13 | 20 | 23 |
| Alloy A | 13.5 | 0.072 | 9 | 14 | 16 |

TABLE 3

| Alloy | Temper | Tensile Yield Str. ksi | Tensile Yield Str. Mpa | Tensile Ultimate ksi | Tensile Ultimate Mpa | Brinell Hardness 500 kg | Elec. Cond. % IACS |
|---|---|---|---|---|---|---|---|
| Invention 1 | H16 | 20.4 | 142 | 22 | 154 | 42.7 | 59.3 |
| Invention 2 | H16 | 17.9 | 125 | 19.3 | 135 | 35.5 | 61.3 |
| High Purity Al | H16 | 13 | 91 | 14 | 98 | 27 | 64.9 |
| Alloy 1070 | H16 | 16.7 | 117 | 17.9 | 125 | 33.1 | 62.1 |
| Alloy A | H16 | 16.9 | 118 | 17.6 | 123 | 33 | 58.5 |

From Tables 2 and 3, it can be easily seen that Invention Alloys 1 and 2 have clear advantages over the others. The Invention Alloys have more strength which is important for robustness and all have an electrical conductivity above 58% I.A.C.S, another important property. The Brinell hardness levels for the Invention Alloys also reflect robustness. High purity aluminum, as expected, was quite weak. In the corrosion tests, high purity aluminum performed very well but its low strength and high cost can make high purity aluminum a poor choice. The Invention Alloy cathode plate material, however, provides quite good corrosion resistance, better than Alloy 1050 and Alloy A, Alloy A being representative of the alloys disclosed in Canadian Patent 1,046,799 (Al+0.05% Ti). Invention Alloy 1 cathode plate can offer a guaranteeable maximum corrosion rate measured in an aqueous bath containing 200 g/l $H_2SO_4$ and 60 g/l zinc sulfate at 38° C. of as good as not more than about 0.044 inches penetration per year per face, preferably 0.042 max, more preferably not more than 0.41 and maximum weight loss of as good as 8 grams weight loss per square meter per day, preferably not more than 7.8, more preferably not more than 7.6. Invention Alloy 2 cathode plate measured in the same aqueous bath composition can offer a guaranteeable maximum corrosion rate of not more than about 0.048, preferably not more than 0.46 inch penetration per year per face and maximum weight loss of as good as not more than 9, preferably not more than 8.8, more preferably not more than about 8.5 grams weight loss per square meter per day. The combination of good strength and robustness along with good corrosion resistance and also good electrical conductivity exhibited by the invention cathode plate is considered a substantial advantage and improvement over the others. Moreover, the higher strength of the invention cathode plate can enable permitting corrosion to a thinner thickness than previously, thereby even further extending cathode plate life.

When referring to a minimum or a maximum (for instance a minimum for strength), such refers to a level at which specifications for materials can be written or a level at which a material can be guaranteed or a level that a user (subject to safety factor) can rely on in design. In some cases, it can have a statistical basis wherein 99% of the product conforms or is expected to conform with 95% confidence using standard statistical methods. As shown above, typical strength properties for invention cathode plate are higher than the minimum levels just set forth.

Unless indicated otherwise, the following definitions apply herein:

a. The term "ksi" is equivalent to kilopounds (1000 pounds) per square inch.

b. Percentages for a composition refer to % by weight.

c. The term "ingot-derived" means solidified from liquid metal by a known or subsequently developed casting process rather than through powder metallurgy techniques. This term shall include, but not be limited to, direct chill casting, electromagnetic casting, spray casting and any variations thereof.

d. In stating a numerical range or a minimum or a maximum for an element of a composition or a temperature or other process matter or a property or an extent of improvement or any other matter herein, and apart from and in addition to the customary rules for rounding off numbers, such is intended to specifically designate and disclose each number, including each fraction and/or decimal, (i) within and between the stated minimum and maximum for a range, or (ii) at and above a stated minimum, or (iii) at and below a stated maximum. (For example, a range of 0.3 to 0.5 discloses 0.31, 0.32, 0.33 . . . and so on, up to 0.5, and a range of 750 to 1000 discloses 751, 752 . . . and so on, up to 1000, including every number and fraction or decimal therewithin, and "up to 0.5" discloses 0.01 . . . 0.1 . . . 0.2 and so on up to 0.5.)

In referring to a corrosion rate or a maximum therefor, such embraces determination thereof by an abbreviated test of, for instance, 24 or 44 hours, or a longer duration test.

Having described the presently preferred embodiments, it is to be understood that the invention may be otherwise embodied within the scope of the appended claims.

What is claimed is:

1. In a method of electrowinning zinc by electrolysis in an electrolyte containing sulfuric acid and zinc sulfate wherein zinc is recovered from an aluminum cathode plate wherein the improvement comprises providing said aluminum cathode plate as an alloy selected from the group consisting of:

(a) an alloy consisting essentially of, by weight, about 0.2 to 0.5% magnesium, 0.15% maximum silicon, 0.1% maximum iron, 0.05% maximum copper, and 0.05% maximum zinc, the balance substantially aluminum and incidental elements and impurities, said aluminum amounting to at least 99.1% of said aluminum alloy; or (b) an alloy consisting essentially of, by weight, about 0.08 to 0.25% silicon, 0.1% maximum iron, 0.05% maximum copper, 0.05% maximum magnesium, 0.05% maximum zinc, the balance substantially aluminum and incidental elements and impurities, said aluminum being at least 99.5% of said alloy, said alloy having a minimum electrical conductivity of at least 57% IACS.

2. The method according to claim 1 wherein said aluminum alloy cathode plate is in a work hardened temper.

3. The method according to claim 1 wherein said aluminum cathode plate has a work hardened temper equivalent to that resulting from a cold rolling reduction of at least 25% in thickness.

4. The method according to claim 1 wherein the cathode plate is about 0.05 to about 0.35 inch thick.

5. The method according to claim 1 wherein the cathode plate is about 0.1 to about 0.3 inch thick.

6. The method according to claim 1 wherein the cathode plate is about 0.125 to about 0.28 inch thick.

7. The method according to claim 1 wherein the alloy has a minimum electrical conductivity of at least 58% IACS.

8. The method according to claim 1 wherein the alloy is in accordance with recitation (b) and the alloy has a minimum electrical conductivity of at least 60% IACS.

* * * * *